US007302215B2

(12) United States Patent
Ahn et al.

(10) Patent No.: US 7,302,215 B2
(45) Date of Patent: Nov. 27, 2007

(54) ELECTROPHOTOGRAPHIC IMAGE FORMING APPARATUS HAVING A SEPARATOR TO SEPARATE A PRINTING MEDIUM FROM A TRANSFER BELT

(75) Inventors: Byeong-hwa Ahn, Seongnam-si (KR); Se-hyung Lyu, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 145 days.

(21) Appl. No.: 11/250,419

(22) Filed: Oct. 17, 2005

(65) Prior Publication Data

US 2006/0115304 A1 Jun. 1, 2006

(30) Foreign Application Priority Data

Dec. 1, 2004 (KR) ..... 10-2004-0099772

(51) Int. Cl.
*G03G 15/16* (2006.01)

(52) U.S. Cl. ..... 399/303; 271/307; 399/313

(58) Field of Classification Search ..... 399/303, 399/304, 313, 302, 308, 323, 397; 271/307, 271/308, 311, 900
See application file for complete search history.

(56) References Cited

U.S. PATENT DOCUMENTS

| | | | | |
|---|---|---|---|---|
| 4,737,816 A | | 4/1988 | Inoue | |
| 4,935,776 A | * | 6/1990 | Fukui | 399/303 X |
| 5,086,318 A | * | 2/1992 | Takeda et al. | 399/303 |
| 5,151,745 A | * | 9/1992 | Durland et al. | 399/304 |
| 5,822,665 A | * | 10/1998 | Yamamoto et al. | 399/303 |
| 5,923,938 A | * | 7/1999 | Enomoto et al. | 399/303 |

FOREIGN PATENT DOCUMENTS

| | | | |
|---|---|---|---|
| JP | 57-190977 | | 11/1982 |
| JP | 59-045477 | | 3/1984 |
| JP | 64-060550 | | 3/1989 |
| JP | 03-100569 | | 4/1991 |
| JP | 08-297428 | | 11/1996 |
| JP | 09015987 | | 1/1997 |
| JP | 11-052663 | | 2/1999 |
| JP | 2000242090 | | 2/1999 |
| JP | 11-174856 A | * | 7/1999 |
| JP | 2000-242090 A | * | 9/2000 |
| JP | 2001-117460 | | 4/2001 |
| JP | 2001-183889 | | 7/2001 |
| JP | 2002-014515 | | 1/2002 |

* cited by examiner

*Primary Examiner*—Sophia S. Chen
(74) *Attorney, Agent, or Firm*—Roylance, Abrams, Berdo & Goodman, L.L.P.

(57) ABSTRACT

An electrophotographic image forming apparatus has a development unit with a photoconductor. A transport belt conveys a printing medium onto which a toner image is transferred from the photoconductor. A separator is disposed inside the transport belt, and is capable of extending outwardly to push the printing medium to separate the printing medium from the transport belt after transferring the toner image.

20 Claims, 8 Drawing Sheets

ELECTROPHOTOGRAPHIC IMAGE FORMING APPARATUS HAVING A SEPARATOR TO SEPARATE A PRINTING MEDIUM FROM A TRANSFER BELT

CROSS REFERENCE TO RELATED APPLICATION

This application claims the benefit under 35 U.S.C. § 119(a) of Korean Patent Application No. 10-2004-0099772, filed on Dec. 1, 2004, in the Korean Intellectual Property Office, the entire disclosure of which is hereby incorporated by reference.

BACKGROUND OF THE INVENTION

1. Field of the Invention

The present invention relates to an electrophotographic image forming apparatus. More particularly, the present invention relates to an electrophotographic image forming apparatus having a separator that separates a printing medium from a transport belt.

2. Description of the Related Art

Typically, an electrophotographic image forming apparatus receives digital image data, and forms a corresponding latent electrostatic image by exposing a photoconductor to a light beam scanned from a laser scan unit (LSU). The latent electrostatic image is developed on the photoconductor into a visible toner image by using toner. The visible toner image is transferred to a printing medium. The toner image is fused on the printing medium by applying heat and pressure to form a predetermined image.

Electrophotographic image forming apparatuses can be divided into dry and wet types depending on toner and carrier. The dry type electrophotographic image forming apparatuses can be divided into one-phase development types and two-phase development types.

The one-phase development electrophotographic image forming apparatus uses only toner to form an image. The two-phase development electrophotographic image forming apparatus uses the carrier containing the toner to form an image.

In the one-phase development electrophotographic image forming apparatus, a development unit applies the toner to the photoconductor to develop a visible toner image. A cleaning blade removes remaining toner of the photoconductor after the visible toner image is transferred. A toner collector collects the removed toner to reuse it. In the two-phase development electrophotographic image forming apparatus, a development unit applies the toner of the carrier to the photoconductor to develop a visible toner image. The remaining carrier is collected. A cleaning blade removes any remaining toner of the photoconductor after the visible toner image is transferred. A toner collector collects the removed toner to reuse it. When printing a color image, the remaining toner of the photoconductor is a mixture of several color toners, such that it is hard to reuse the remaining toner.

A color image forming apparatus includes cyan, yellow, magenta, and kara (black) developer cartridges that are sequentially arranged.

The developer cartridges may share one photoconductor or may be respectively provided with more than one photoconductor.

When sharing the photoconductor, the developer cartridges sequentially apply toner to the photoconductor on which an electrostatic latent image corresponding to digital image data is formed. The applied toners are overlapped to form a visible toner image. The visible toner image is transferred to a printing medium by an intermediate transfer unit.

When each of the developer cartridges is provided with the photoconductor, a transport unit is installed to face all the photoconductors of the developer cartridges. Toner images with different colors are sequentially transferred from the photoconductors to the printing medium when the transport unit conveys the printing medium, such that the toner images can be overlapped on the printing medium to form an image.

After the image is formed on the printing medium, the printing medium must be separated from the transport unit. The curvature of a roller of the transport unit enables this separation of the printing medium. However, since the printing medium is charged during the toner image transferring it is hard to separate the printing medium having a thin thickness from the transport unit using the roller's curvature, thereby causing jamming due to non-separation or delayed separation of the printing medium.

Accordingly, a need exists for an improved electrophotographic image forming apparatus that easily separates a printing medium from a transport unit.

SUMMARY OF THE INVENTION

The present invention provides an electrophotographic image forming apparatus in which a printing medium, regardless of its thickness, is stably separated from a transport belt by a separator after a toner image is transferred to the printing medium.

According to an aspect of the present invention, an electrophotographic image forming apparatus has a development unit provided with a photoconductor, and includes a transport belt that conveys a printing medium onto which a toner image is transferred from the photoconductor. A separator is disposed inside of a loop formed by the transport belt, and is capable of extending outwardly to push the printing medium to separate the printing medium from the transport belt after the toner image is transferred.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
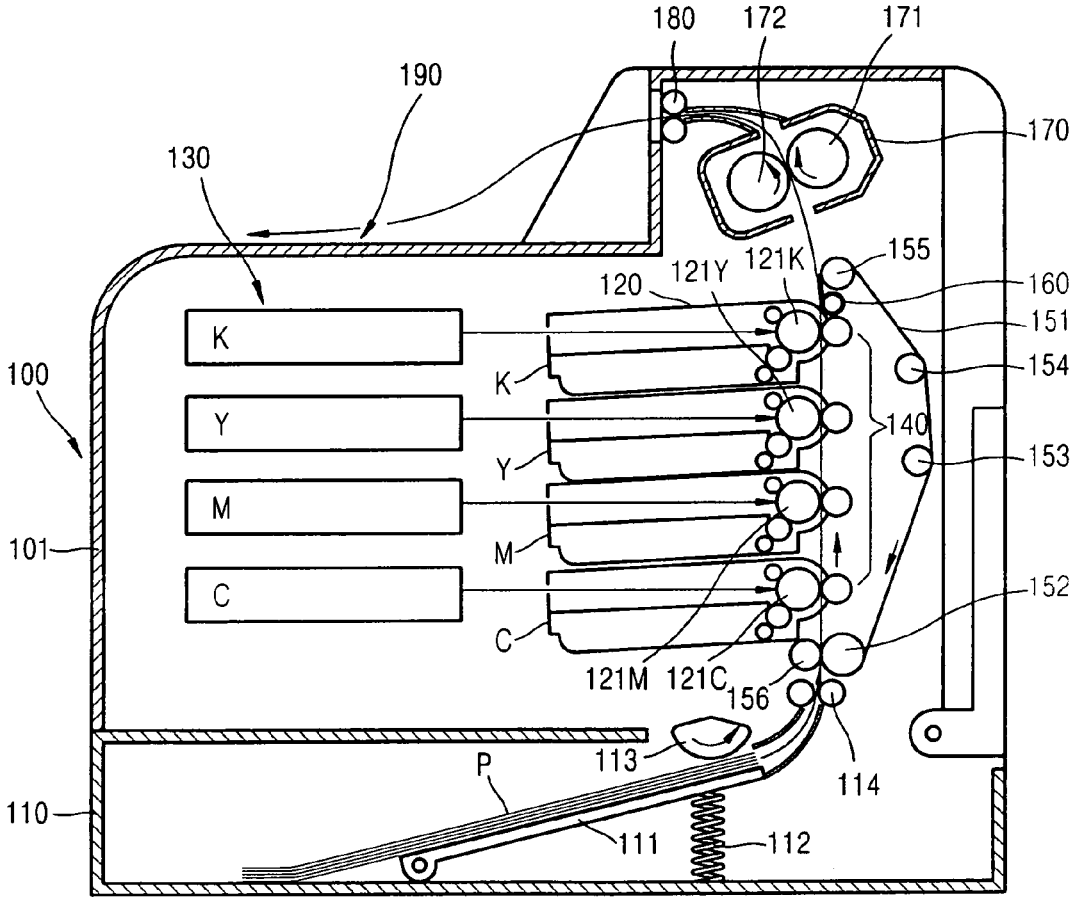
FIG. 1 is a sectional view of an electrophotographic image forming apparatus having a separator according to an exemplary embodiment of the present invention.

FIG. 1 is a sectional view of an electrophotographic image forming apparatus 100 having a separator according to an exemplary embodiment of the present invention.

Referring to FIG. 1, the electrophotographic image forming apparatus 100 prints an image on a printing medium (P) according to an electrophotographic image forming process. The electrophotographic image forming apparatus 100 includes a main body 101 and a cassette 110 removably installed at a lower portion of the main body 101 to load the printing media (P).

The cassette 110 includes a plate 111 and a spring 112. The printing media (P) are loaded on the plate 111 biased at one end portion by the spring 112. A pick-up roller 113 is installed above the cassette. The pick-up roller 113 picks up the printing media (P) one by one as it rotates, and the printing media is fed by feed rollers 114.

Further, the electrophotographic image forming apparatus 100 includes a developer cartridge 120, a laser scan unit (LSU) 130, transfer rollers 140, a transport belt 151, a separator 160, a fuser 170, and eject rollers 180.

The developer cartridge 120 includes cyan, magenta, yellow, and kara (black) developer cartridges 120C, 120M, 120Y, and 120K that are respectively provided with photoconductive drums 121C, 121M, 121Y, and 121K. The developer cartridges 120C, 120M, 120Y, and 120K are filled with toners to apply the toners to electrostatic latent images formed on the photoconductive drums 121C, 121M, 121Y, and 121K to develop the electrostatic latent images into toner images.

The LSU 130 scans light beams to the photoconductive drums 121C, 121M, 121Y, and 121K to form electrostatic latent images corresponding to digital image data. The LSU 130 includes cyan, magenta, yellow, and kara LSUs 130C, 130M, 130Y, and 130K.

Supporting rollers 152, 153, 154, and 155 support the transport belt 151. When the printing medium (P) is picked up and fed to the transport belt 151, the transport belt 151 conveys the printing medium (P) along the developer cartridges 120C, 120M, 120Y, and 120K, such that the printing medium (P) is sequentially faced with the developer cartridges 120C, 120M, 120Y, and 120K. Herein, the photoconductive drums 121C, 121M, 121Y, and 121K of the development cartridges 120C, 120M, 120Y, and 120K are abutted against the transport belt 151 when the transport belt 151 conveys the printing medium (P).

A charge roller 156 is disposed proximal a lower portion of the transport belt 151 to charge the transport belt 151 with a predetermined potential, such that the printing medium (P) may be attached to the transport belt 151.

The transfer rollers 140 are disposed inside of the loop defined by the transport belt 151 and respectively aligned with the developer cartridges 120C, 120M, 120Y, and 120K, such that when the transport belt 151 conveys the printing medium (P) the toner images formed on the photoconductive drums may be sequentially transferred and overlapped to the printing medium (P) to form an image.

The fuser 170 applies heat and pressure to the image to securely attach the image on the printing medium (P). The fuser 170 includes a heat roller 171 that applies heat to the image, and a pressure roller 172 engaged with the heat roller 171. The pressure roller 172 presses the printing medium (P) toward the heat roller 171 when the printing medium (P) passes therebetween.

The eject rollers 180 eject the printing medium (P) out of the electrophotographic image forming apparatus 100. The eject rollers 180 include a pair of rollers that are disposed proximal to each other. The ejected printing medium (P) is directed to an output tray 190.

Figure 2:
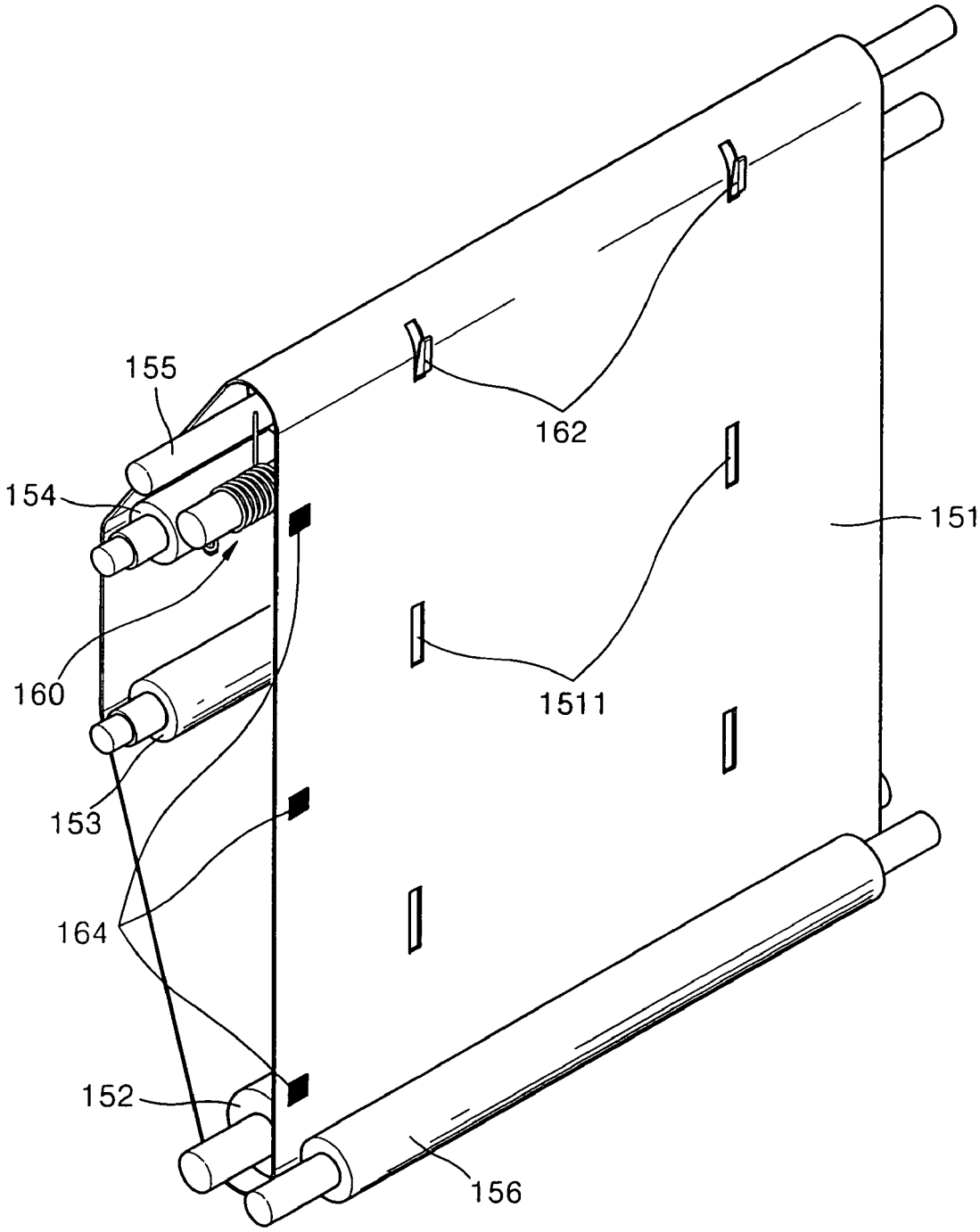
FIG. 2 is a perspective view of a transport belt with the separator depicted in FIG. 1.
Figure 3:
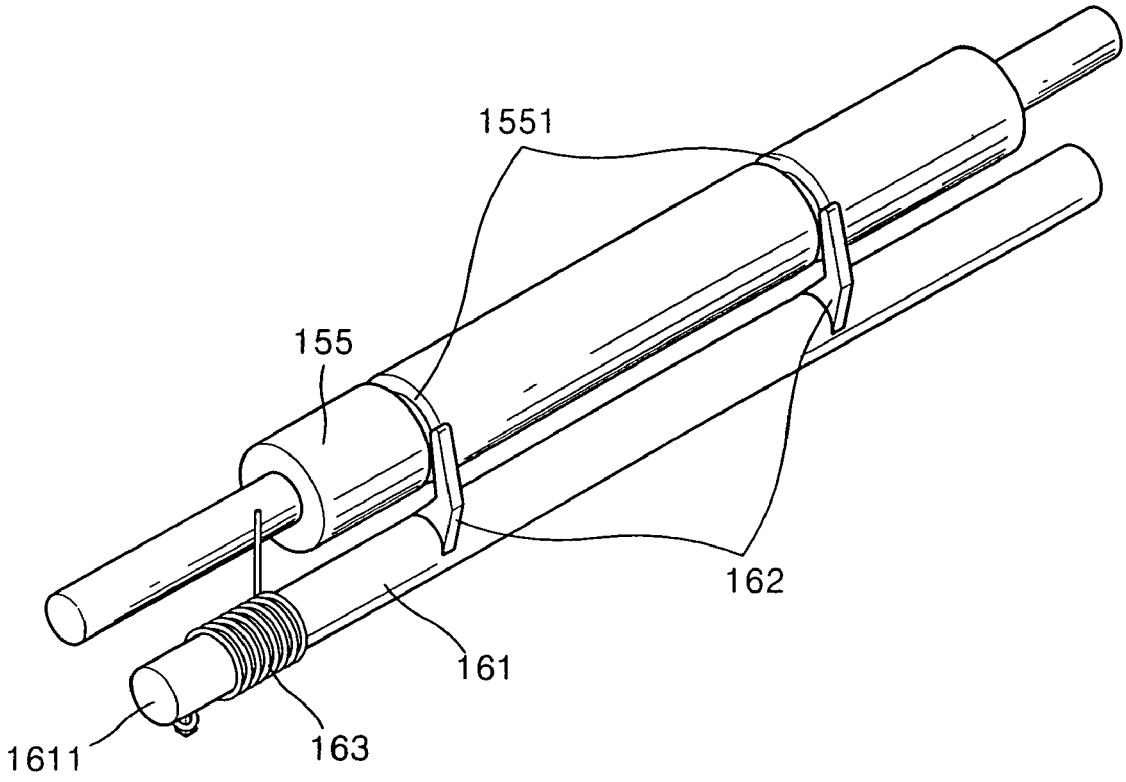
FIG. 3 is a perspective view of the separator depicted in FIG. 1.

FIG. 2 is a perspective view of the transport belt with the separator depicted in FIG. 1. FIG. 3 is a perspective view of the separator depicted in FIG. 1.

Referring to FIGS. 2 and 3, the separator 160 is disposed inside of a loop formed by the transport belt 151 to separate the printing media (P) from the transport belt 151. The separator 160 includes a shaft 161, levers 162, and an elastic member 163.

The shaft 161 is parallel with the supporting roller 155 and it is rotatably fixed to the main body 101. The shaft 161 includes a supporting end 1611.

The levers 162 protrude from the shaft 161 with a predetermined distance therebetween and face the transport belt 151. The supporting roller 155 includes corresponding grooves 1551 adapted to receive the levers 162. Since the levers 162 are received in the grooves 1551, the levers 162 do not hinder the transport belt 151 when it is rotated by the supporting roller 155.

The elastic member 163 is turned around an end portion of the shaft 161. The elastic member 163 has one end supported by the supporting roller 155 and the other end supported by the supporting end 1611.

When the elastic member 163 is compressed, the elastic member 163 exerts an elastic force to rotate the shaft 161 clockwise. The levers 162 are also rotated when the shaft 161 is rotated by the elastic member 163.

The transport belt 151 defines slots 1511 through which the levers 162 spring out. The slots 1511 are defined along the transport belt 151 with a predetermined distance therebetween. Preferably, the predetermined distance between the levers 162 is substantially equivalent to the predetermined distance between the slots 1511.

When the levers 162 meet the slots 1511 during the rotation of the transport belt 151, the elastic member 163 causes the levers 162 to extend outwardly from the slots 1511. As the slots 1511 pass over the extended levers 162, the extended levers 162 are pushed and moved back to the grooves 1551.

When the levers 162 meet the next slots 1511 during the rotation of the transport belt 151, the levers 162 are extended outwardly from the slots 1511 again.

That is, each time the slots 1511 reach the levers 162, the levers 162 are extended from the slots 1511.

The transport belt 151 also includes marks 164 along and between the slots 1511. The marks 164 may be arranged adjacent to an edge of the transport belt 151. The marks 164 are provided to detect the slots 1511.

Figure 4:
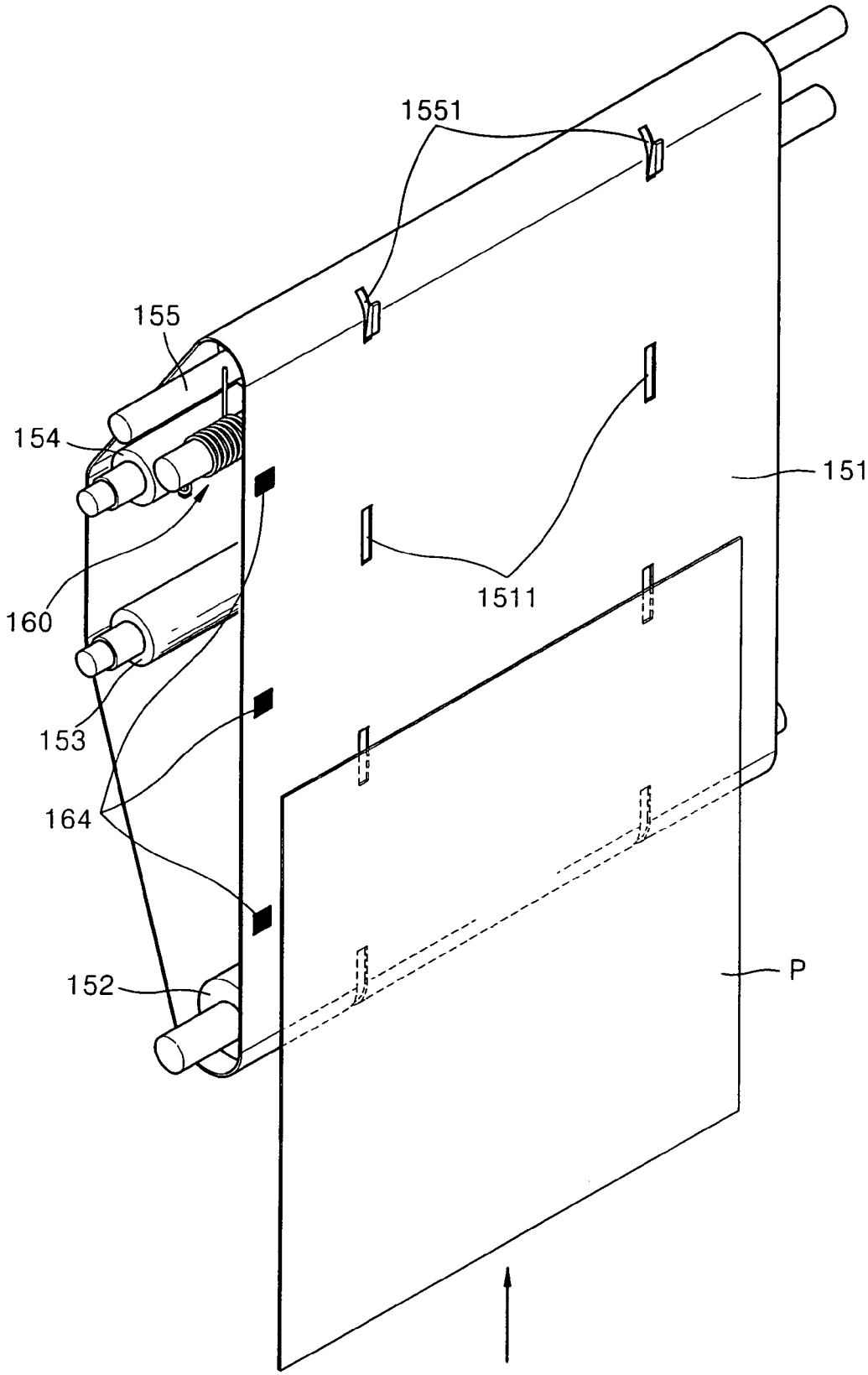
FIG. 4 is a perspective view showing the transport belt with the separator when a printing medium is conveyed according to an exemplary embodiment of the present invention.

FIG. 4 is a perspective view showing a transport belt with a separator when a printing medium is conveyed according to an exemplary embodiment of the present invention.

Referring to FIG. 4, to separate the leading edge of the printing media (P) from the transport belt 151 by using the levers 162, the leading edge of the printing media (P) is aligned with the slots 1511.

The pick-up roller 113 is controlled to pick up the printing media (P) according to the position of the slots 1511 detected using the mark 164, such that the leading edge of the printing media (P) may be placed on the slots 1511.

The separating operation of the separator 160 is described with reference to the accompanying drawings.

Figure 5:
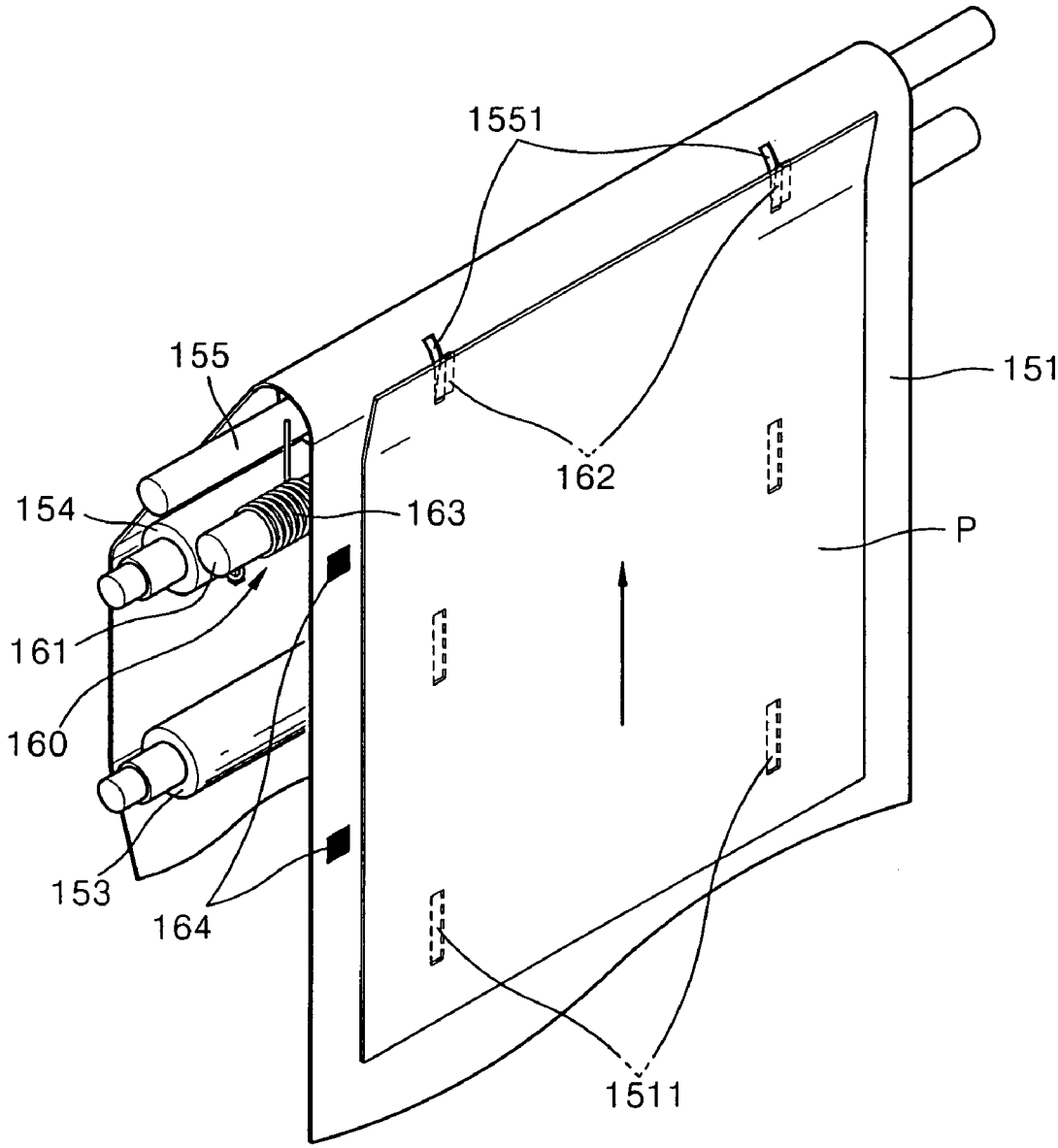
FIG. 5 is a partial perspective view showing the transport belt with the separator when a leading edge of a printing medium is separated from the transport belt according to an exemplary embodiment of the present invention.
Figure 6:
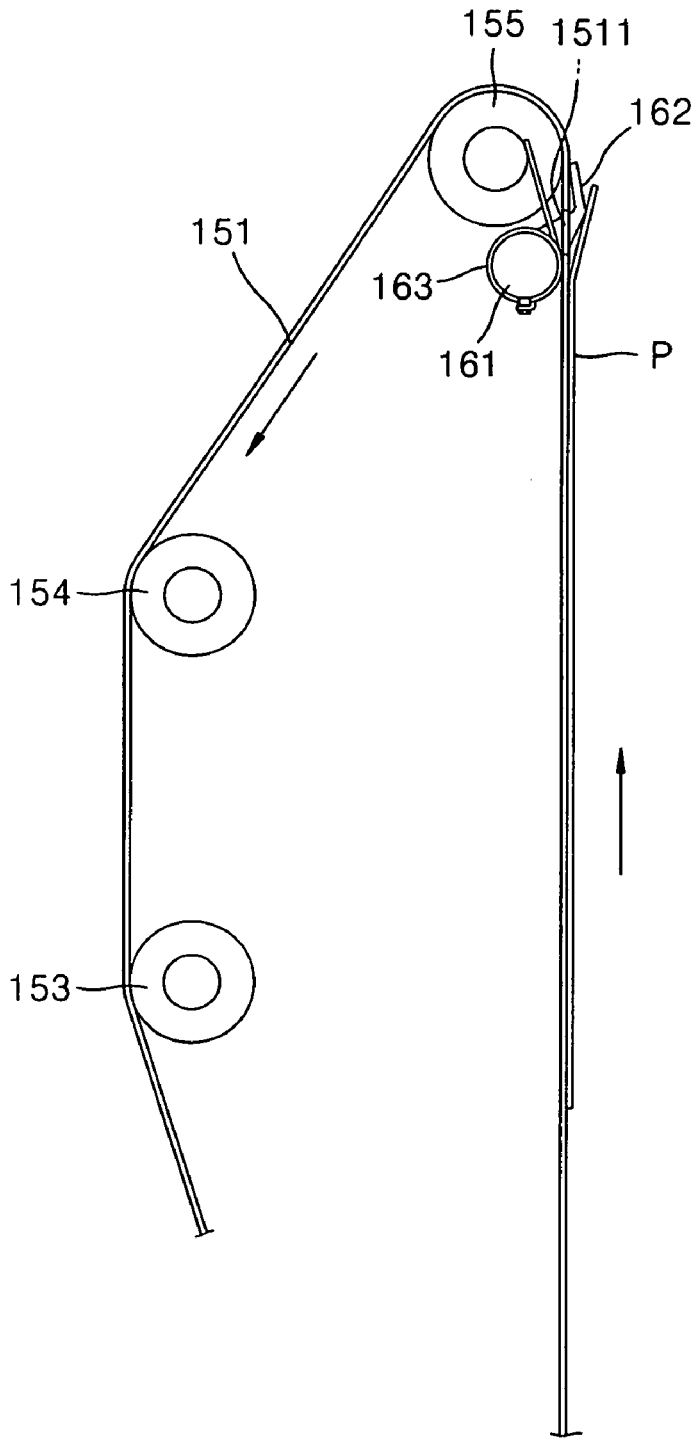
FIG. 6 is an elevational view showing the transport belt with the separator when a leading edge of a printing medium is separated from the transport belt according to an exemplary embodiment of the present invention.

FIG. 5 is a partial perspective view showing the transport belt with the separator when a leading edge of a printing medium is separated from the transport belt according to an exemplary embodiment of the present invention. FIG. 6 is an elevational view showing the transport belt with a separator when a leading edge of a printing medium is separated from the transport belt according to an exemplary embodiment of the present invention.

Referring to FIGS. 5 and 6, the transport belt 151 is supported by the supporting rollers 153, 154, and 155, and it conveys a printing medium (P) of which leading edge is aligned with the slots 1511. When the slots 1511 pass over the levers 162, the elastic member 163 urges the levers 162 toward the slots 1511.

The levers 162 are extended from the slots 1511 to push the leading edge of the printing media (P), such that the leading edge of the printing media (P) is separated from the transport belt 151.

Figure 7:
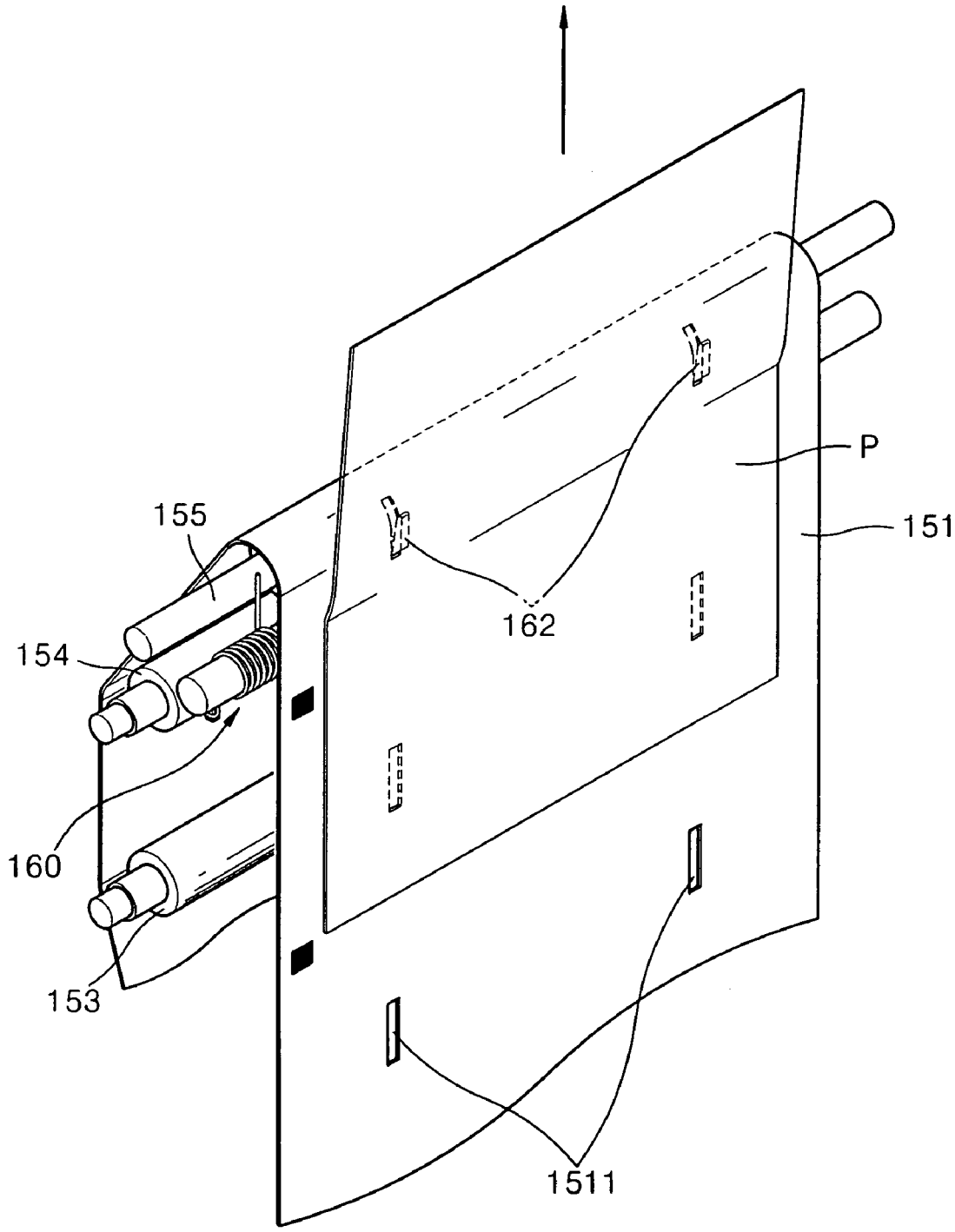
FIG. 7 is a partial perspective view showing the transport belt with the separator when a printing medium is partially separated from the transport belt according to an exemplary embodiment of the present invention.
Figure 8:
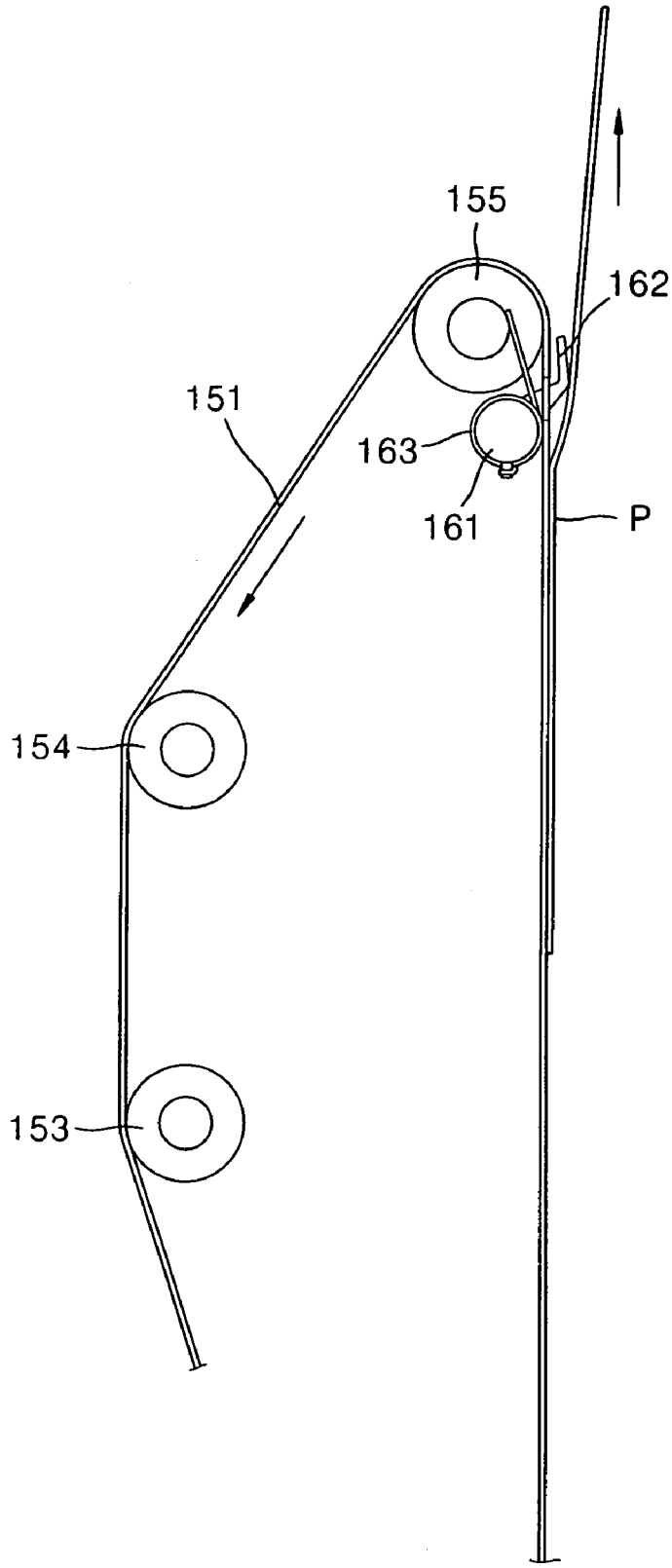
FIG. 8 is an elevational view showing the transport belt with the separator when a printing medium is partially separated from the transport belt according to an exemplary embodiment of the present invention.

FIG. 7 is a partial perspective view showing the transport belt with the separator when a printing medium is partially separated from the transport belt according to an exemplary embodiment of the present invention. FIG. 8 is an elevational view showing the transport belt with the separator when a printing medium is partially separated from the transport belt according to an exemplary embodiment of the present invention.

Referring to FIGS. 7 and 8, as the slots 1511 pass over the levers 162, the levers 162 are pushed by the transport belt 151 and therefore retracted to the grooves 1551.

When the next slots 1511 pass over the levers 162, the levers 162 are extended again to push the printing media (P) away from the transport belt 151. The levers 162 repeat this motion to completely separate the printing media (P) from the transport belt 151.

As described above, the electrophotographic image forming apparatus of an exemplary embodiment of the present invention is designed such that the printing medium (P), regardless of its thickness, is easily separated from the transport belt 151 by the repeatedly extending motion of the separator, thereby preventing the printing medium from being jammed.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic image forming apparatus having a development unit provided with a photoconductor, comprising:

a transport belt conveying a printing medium for transferring a toner image from the photoconductor to the printing medium; and a separator disposed inside a loop defined by the transport belt around at least two rollers, the separator being capable of extending outwardly to push the printing medium to separate the printing medium from the transport belt after transferring the toner image.

2. The electrophotographic image forming apparatus of claim 1, wherein the separator includes a shaft;

a plurality of levers protruding from the shaft with a first predetermined distance therebetween; and an elastic member urging the shaft toward transport belt.

3. The electrophotographic image forming apparatus of claim 2, wherein the elastic member includes a first end supported by a supporting roller disposed inside of the loop defined by the transport belt; and a second end supported by a supporting end of the shaft.

4. The electrophotographic image forming apparatus of claim 3, wherein the supporting roller has a plurality of grooves adapted to receive the plurality of levers.

5. The electrophotographic image forming apparatus of claim 4, wherein the plurality of levers are received by the plurality of grooves in the supporting roller when not protruding through a plurality of slots in the transport belt.

6. The electrophotographic image forming apparatus of claim 2, wherein the transport belt has a plurality of slots arranged in a predetermined pattern and through which the plurality of levers are extended and retracted.

7. The electrophotographic image forming apparatus of claim 6, wherein the plurality of slots are separated by a second predetermined distance.

8. The electrophotographic image forming apparatus of claim 7, wherein the second predetermined distance is substantially equivalent to the first predetermined distance.

9. The electrophotographic image forming apparatus of claim 6, wherein the transport belt has a plurality of marks disposed between the slots in a direction of belt travel.

10. The electrophotographic image forming apparatus of claim 9, wherein the plurality of marks are arranged adjacent to an edge of the transport belt.

11. The electrophotographic image forming apparatus of claim 6, wherein the plurality of levers extend through the plurality of slots to separate the printing medium from the transport belt.

12. The electrophotographic image forming apparatus of claim 11, wherein the plurality of levers are disposed on a first side of the transfer belt and the printing medium is disposed on a second and opposing side of the transfer belt.

13. The electrophotographic image forming apparatus of claim 2, wherein the plurality of levers are moved toward and away from the transport belt according to a rotation of the transport belt.

14. An electrophotographic image forming apparatus, comprising:

a transport belt adapted to convey a printing medium;

a plurality of slots disposed in the transport belt in a predetermined pattern;

a shaft disposed inside a loop defined by the transport belt;

a plurality of levers protruding from the shaft with a first predetermined distance therebetween; and an elastic member urging the shaft toward transport belt;

whereby the plurality of levers are adapted to pass through the plurality of slots in the transport belt to push the printing medium to separate the printing medium from the transport belt.

15. The electrophotographic image forming apparatus of claim 14, wherein the elastic member has a first end supported by a supporting roller disposed inside of the loop defined by the transport belt; and a second end of the elastic member is supported by a supporting end of the shaft.

16. The electrophotographic image forming apparatus of claim 15, wherein the plurality of levers are received by a plurality of grooves in the supporting roller when not protruding through the plurality of slots in the transport belt.

17. The electrophotographic image forming apparatus of claim 14, wherein the transport belt has a plurality of marks disposed between the slots in a direction of belt travel.

18. The electrophotographic image forming apparatus of claim 17, wherein the plurality of marks are arranged adjacent to an edge of the transport belt.

19. A method of separating a printing medium from a transport belt, comprising the steps of attaching a printing medium to a transport belt;

conveying the printing medium on the transport belt;

passing a plurality of levers through a plurality of slots in the transport belt to separate the printing medium from the transport belt; and retracting the plurality of levers through the plurality of slots in the transport belt and receiving the plurality of levers in a plurality of grooves disposed in a supporting roller such that the plurality of levers do not substantially impede travel of the transport belt.

20. A method of separating a printing medium from a transport belt according to claim 19, further comprising biasing the plurality of levers toward the transport belt with an elastic member disposed on a shaft to which the plurality of levers are connected.

* * * * *